US005110231A

United States Patent [19]

Monteith et al.

[11] Patent Number: 5,110,231

[45] Date of Patent: May 5, 1992

[54] FLUID SPRAY CLEANING SYSTEM

[75] Inventors: Robert D. Monteith, Villa Park; Keith Johnson, So. Laguna, both of Calif.

[73] Assignee: George M. Stephenson, Bethel, Conn.

[21] Appl. No.: 697,699

[22] Filed: May 9, 1991

[51] Int. Cl.[5] ..... A46B 5/02; A46B 11/02; B65D 83/20

[52] U.S. Cl. ..... 401/190; 401/279; 401/207; 239/390; 222/529; 222/402.14

[58] Field of Search ..... 401/190, 279, 278, 207, 401/118, 204, 206; 239/390, 397, 530; 222/529, 402.11, 402.14, 402.25; 251/288

[56] References Cited

U.S. PATENT DOCUMENTS

| | | | |
|---|---|---|---|
| 2,151,656 | 3/1939 | Folke | 251/288 X |
| 2,417,370 | 3/1947 | Magann et al. | 401/279 |
| 2,830,588 | 4/1958 | Davis | 401/190 X |
| 3,305,144 | 2/1967 | Beres et al. | 401/190 X |
| 3,387,911 | 6/1968 | Focht | 401/190 |
| 3,428,224 | 2/1969 | Eberhardt et al. | 222/402.14 X |
| 3,468,611 | 9/1969 | Ward | 401/206 X |
| 3,650,438 | 3/1972 | Stephenson et al. | 222/402.22 |
| 4,350,299 | 9/1982 | Stephenson et al. | 401/190 X |
| 4,773,567 | 9/1988 | Stoody | 222/402.11 X |

FOREIGN PATENT DOCUMENTS

| | | | |
|---|---|---|---|
| 2632935 | 12/1989 | France | 222/402.14 |

*Primary Examiner*—Danton D. DeMille

*Attorney, Agent, or Firm*—Parmelee, Bollinger & Bramblett

[57] ABSTRACT

A hand-operated cleaning system includes an ON/OFF control unit snap-on mountable onto a pressurized container having a valve stem for delivering cleaning liquid. This control unit includes an outer cap with resilient fingers adapted to snap-grip engage and mount the control unit onto a top rim of the container. An inner cap is mounted within the outer cap for ON/OFF helical turning movement so that turning the inner cap in the ON direction depresses the valve stem for releasing pressurized liquid from its container, and turning it in the OFF direction stops such release. A fluid passageway extends from the valve stem through the inner cap to a length of flexible tubing coupled to the inner cap and extending to a remotely-located, hand-held applicator wand. This applicator wand has a fluid passageway communicating with the flexible tubing for providing a path through the wand to its nozzle end. A valve is positioned in the wand for operation by a button actuator. Depressing this button actuator by a user's thumb or forefinger opens the valve for delivering fluid out through an axial bore of the nozzle. A brush is mountable in the nozzle bore so that solvent dispensed through the nozzle bore for brushing application of dispensed liquid onto a surface to be cleaned. The button-actuated valve is spaced away from the end of the elongated nozzle for enabling the nozzle and brush to reach into places of difficult access.

6 Claims, 5 Drawing Sheets

FLUID SPRAY CLEANING SYSTEM

BACKGROUND OF THE INVENTION

This invention relates to a solvent spray cleaning brush system which is attachable to a can of pressurized solvent for controllably and conveniently delivering solvent from the can through a length of flexible tubing to a spray cleaning brush applicator wand at a remote location in the hand of the operator at the remote location.

Typical pressurized aerosol spray cans are generally operated by a depressible release valve stem having a button on the valve stem which must be pointed or aimed in the direction to which the contents of the can are to be discharged. The operation of this type of aerosol container can, in many instances, entails delivery problems, such as the spray not being concentrated or covering too large an area. Moreover, a narrow location into which the solvent contents of the can are to be applied makes it inconvenient or difficult to maneuver or aim the release valve button on the top of the can in a desired position or direction to deliver the contents of the can to an intended location.

For example, in removing or cleaning small intricate parts, such as cameras, lenses and all sorts of mechanical and electrical components, the manipulation of a pressurized container in order to deliver the cleaning solvent to reach the surfaces to be cleaned is often difficult or very inconvenient or ineffective.

A prior system which addresses this problem of remote delivery is shown and described in U.S. Pat. No. 3,650,438, issued Mar. 21, 1972, which provides a remote delivery nozzle attached through a length of flexible tubing to the aerosol can, and the nozzle is directly connected to a tiltable-discharge-controlling nozzle valve. The system shown in that patent includes a special eccentrically apertured rotatable container cap along with special sleeve couplings which cooperate with the rotatable cap either to turn on or to shut off the delivery of pressure from the can. When the pressure delivery is turned on, the pressure is available through the length of flexible tubing to the tiltable-discharge-controlling nozzle valve.

The prior system shown in the patent has several drawbacks which include the provision of a special cap for use on an aerosol container and having an eccentric aperture as well as an eccentric coupling. The special eccentric rotatable cap fits on the outside of the top of the aerosol can, and rotation of that cap when the aerosol can is to be actuated causes the flexible tubing itself to become awkwardly inclined away from vertical in an unbalanced destabilizing orientation. This special cap with its eccentric aperture is continuously rotatable relative to the aerosol can. Thus, there is no positive mechanical stop for preventing the user from rotating the cap beyond its full-ON or full-OFF orientations. The user must align visual indicia to determine the full-ON and full-OFF positions, rather than having the benefit of positive mechanical stops for providing reliable operations.

In addition, the remote nozzle is directly mounted onto a tiltable delivery valve and necessary tilting of the nozzle tip for opening the valve causes difficulty in aiming the nozzle for appropriate delivery of the spray from the nozzle opening. Furthermore, the opening in this tiltable nozzle is located in the side of the nozzle tip where it is difficult to aim accurately during tilting of the nozzle tip. Furthermore, it would be difficult to attach implements, such as a cleaning brush, to the end of such a tiltable, side-opening nozzle for applying the contents of the aerosol can by a brushing action to the surface to be cleaned.

In summary, the apparatus shown in that Patent involving an eccentric cap for rotation tilting of a valve stem on the can as well as the awkward tiltable nozzle and valve delivery system with a side opening in the nozzle tip cause various problems for a user in attempting accurate delivery and application of a cleaning liquid.

SUMMARY OF THE INVENTION

Accordingly, it is an object of the present invention to provide a new and improved solvent spray cleaning brush system which is convenient, economical and may readily be attached to or detached from conventional pressurized aerosol containers.

Another object of this invention is to provide such a system with an effective arming and disarming control of the pressure supplied from the aerosol can using a convenient nap-on attachment which locally controls dispensing of the contents of the pressurized container by providing a definitive ON/OFF control with mechanical stops for both the full-ON and full-OFF positions of a manually movable thumb tab.

Still another object of this invention is to provide a solvent spray cleaning brush system having a controllable solvent delivery wand in which a control valve is mounted in the body of the wand permitting a cleaning brush to be inserted in the dispensing nozzle end of the wand where the brush becomes bathed with the cleaning liquid.

A further object of the present invention is to provide a new and improved solvent spray cleaning brush system having an applicator wand in which the dispensing control of the wand is conveniently located in the body of the wand at a considerable distance away from the dispensing nozzle end of the wand, thereby permitting better aiming and directing of the dispensing end of the nozzle with its brush to be applied to the work surfaces where desired and enabling reaching of the nozzle into narrow spaces of difficult access.

Among the advantages of the present invention are those resulting from the provision of a new and improved solvent spray cleaning brush system which is easy to operate, offers fingertip control and pin-point cleaning access, reduces waste, fits a large variety of aerosol cans, and is functionally and ergonomically designed for comfort, balance and performance.

In carrying out this invention in one illustrative embodiment thereof, a solvent spray cleaning brush system is adapted to be detachably mounted on a pressurized solvent container having an upstanding closure valve stem mounted on the container for dispensing solvent from the container when the valve stem is actuated by depressing the valve stem. ON/OFF actuator control means are provided having an outer cap with a snap-on clamp on a first end thereof with spaced, downwardly extending, resilient fingers. These resilient fingers are adapted to engage and mount the actuator control onto the top of a pressurized container which dispenses a cleaning solvent. The actuator control means comprise an inner cap mounted for limited rotational and axial movement relative to the outer cap. Such movement of the inner cap is adapted to depress and actuate a valve stem on the container on which the actuator control means are mounted. A first fluid conduit extends through the inner cap. A length of flexible tubing is used, having first and second ends, with its first end coupled to the inner cap of the actuator control means and with its second end coupled to a remote pressure release applicator wand which has a second fluid conduit in the wand. A valve is positioned in this second conduit in the wand for opening and closing the conduit, and a button actuator on the wand operates the valve to open and close the valve, thereby providing for convenient button actuation of the valve for delivering cleaning fluid from the dispensing end of the nozzle on the wand when the actuator control means has been turned "ON" in operative position on a container of pressurized cleaning liquid.

BRIEF DESCRIPTION OF DRAWINGS OF THE PREFERRED EMBODIMENT

The invention, together with further objects, features, aspects and advantages thereof, will be more clearly understood from a consideration of the following description in connection with the accompanying drawings, which are not necessarily to scale, and in which the same reference numerals are utilized to indicate like elements throughout the various views.

FIGS. 2A-C, 3A and 3B, 4, 4A, 5-8 are all drawn to a scale of about twice actual full size.

Figure 4A:
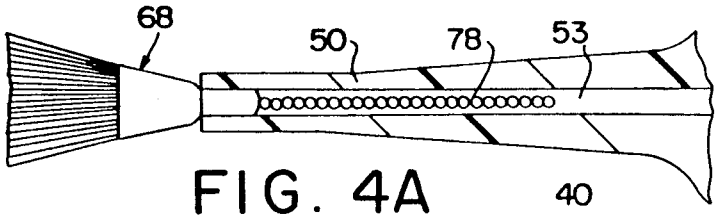
FIG. 4A illustrates a cleaning brush implement inserted into the dispensing end of the nozzle of the wand of FIG. 4.
Figure 4:
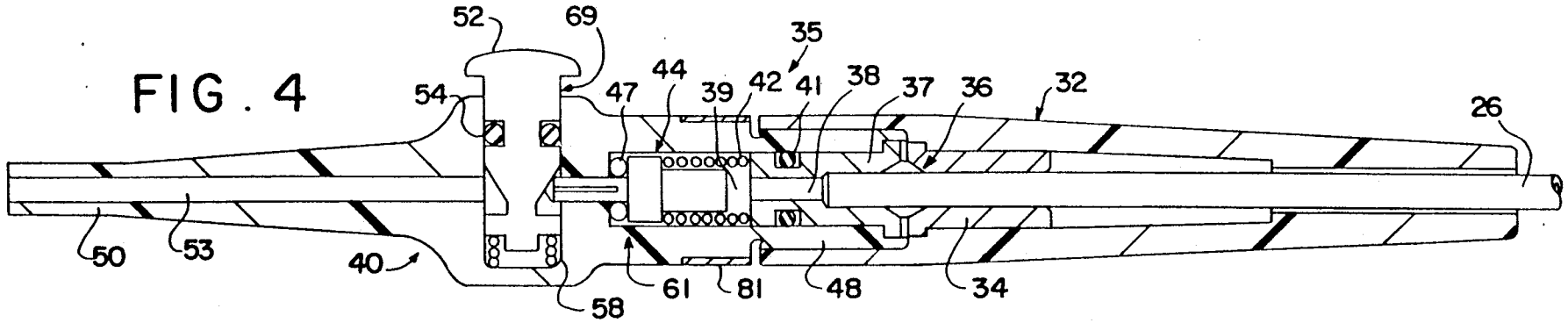
FIG. 4 is an elevational sectional view of a preferred applicator wand employed in the illustrative embodiment of the present invention.
Figure 9:
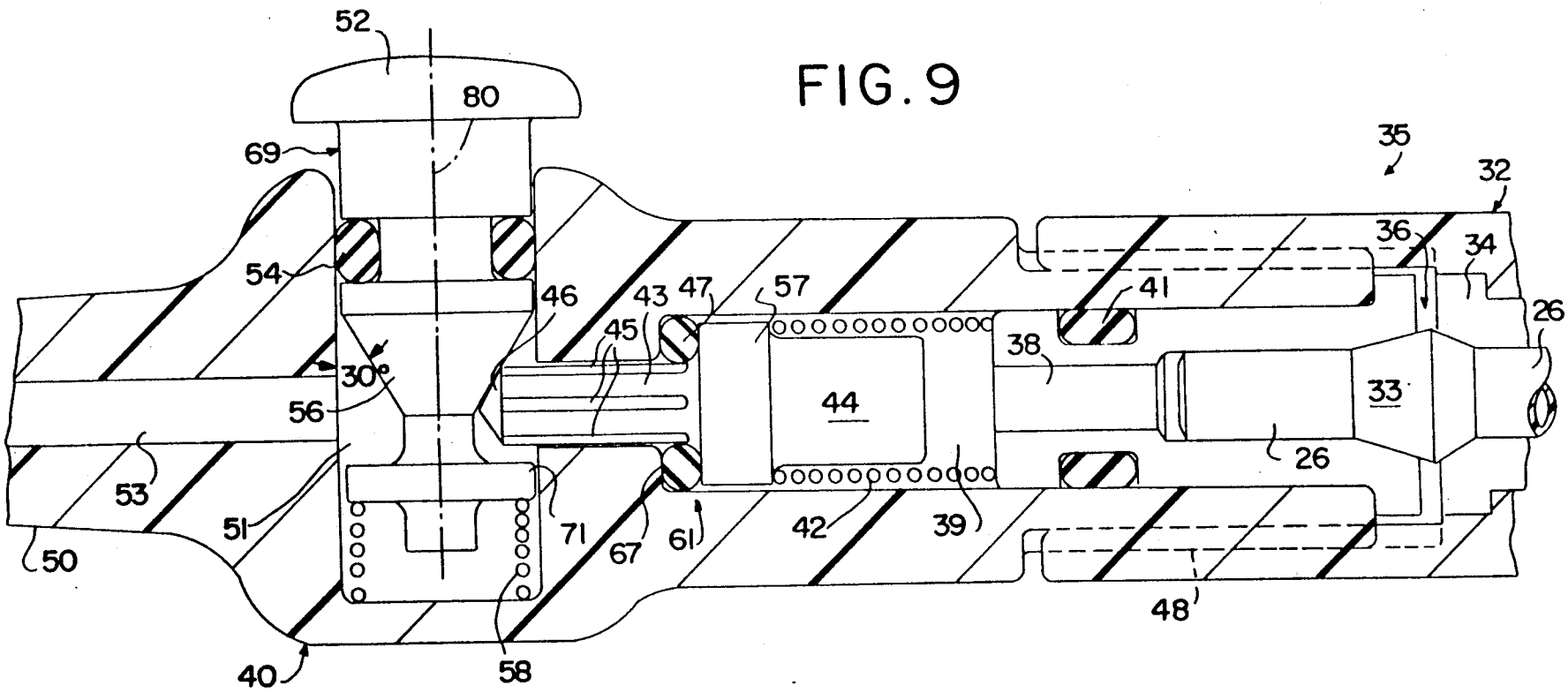

FIG. 9 is a greatly enlarged partial elevational sectional view of the applicator wand shown in FIG. 4 for illustrating the operation of an actuator button and cooperating valve which are mounted in the wand illustrated in FIGS. 4, 4A, 5 and 6.

DETAILED DESCRIPTION OF THE PREFERRED EMBODIMENTS

Figure 1:
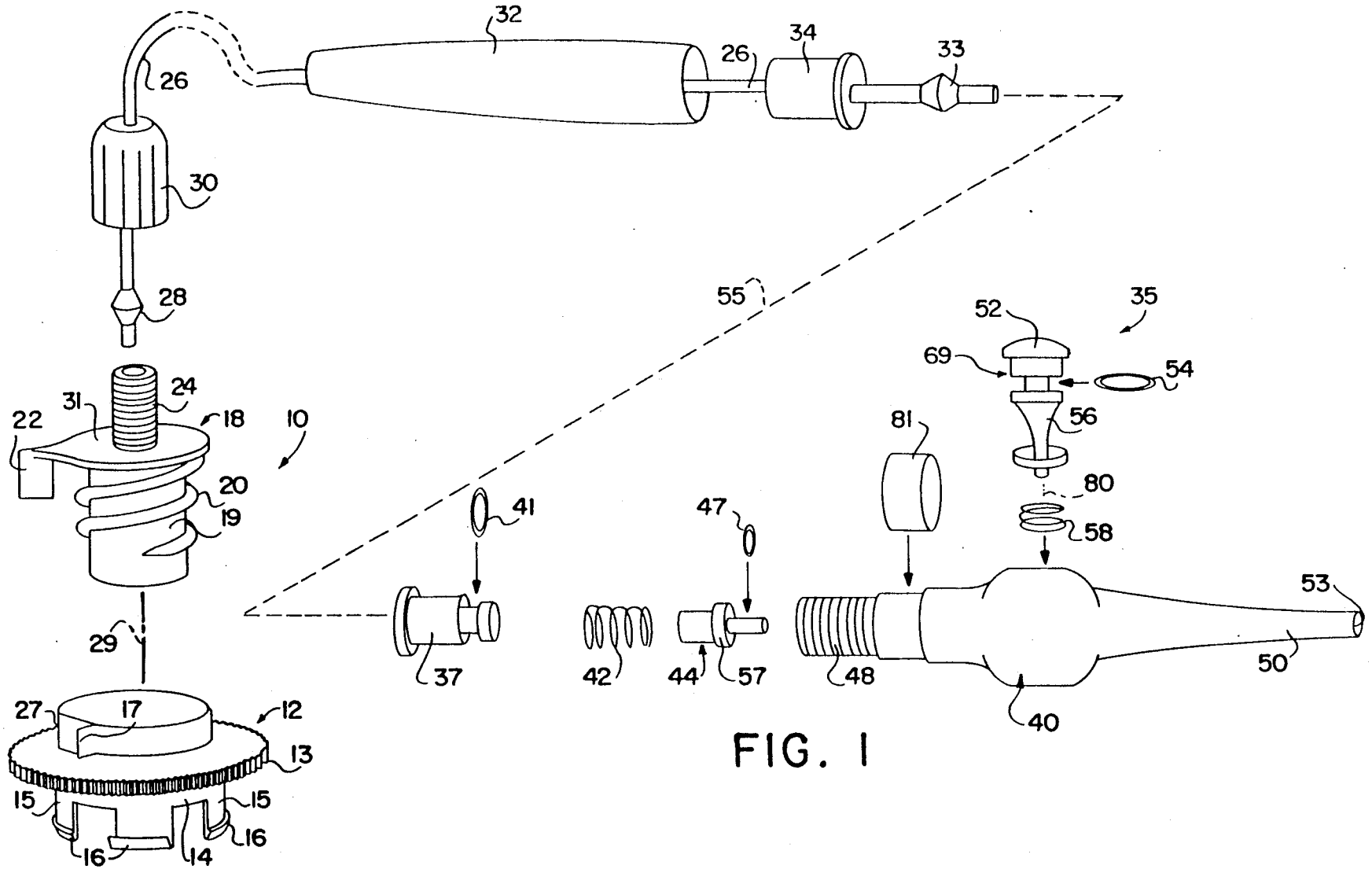
FIG. 1 is an exploded perspective view showing the various individual elements of the applicator wand-controlled solvent spray cleaning system embodying the present invention.

Reference is now made to FIG. 1 which illustrates in exploded view the solvent spray cleaning brush system embodying the present invention in a preferred form. This system includes actuator cap ON/OFF control means, identified generally by the reference numeral 10, comprising an outer cap 12 adapted to receive an inner cap 18. The purpose of this ON/Off actuator control means 10 is to enable a user to turn ON or OFF the availability of pressurized cleaning liquid so as to be deliverable from a pressurized container onto which this control means 10 has been mounted. When this control means 10 has been turned ON, as will be explained later, pressurized cleaning liquid is delivered through a length of flexible tubing 26 to an applicator wand 35 located remotely from the pressurized solvent container and having a push button 52 for actuating a valve 61 (FIG. 9) within the applicator wand. Depressing this valve button 52 causes the solvent to be fed out through the bore of an elongated nozzle 50 at the dispenser front end of the applicator wand 35. In use a cleaning brush 68 (FIG. 4A) has its shank inserted into the bore of the dispenser nozzle 50, so that the cleaning solvent bathes the brush bristles for effective, efficient cleaning of the desired work surfaces.

The outer cap 12 has a knurled edge 13 and a snap-on gripper clamp 14 on the underside thereof including a plurality of separated, downwardly projecting resilient fingers 15. These resilient gripper fingers 15 have radially outwardly extending abrupt-angled ridges 16 thereon at their lower ends. As will be explained later in reference to FIG. 7, these griper fingers are adapted to mount the actuator cap means 10 onto the top of an aerosol container whose pressurized contents are to be employed. The outer cap 12 includes a first stop 17 positioned on the cylindrical outside surface of an upstanding circular wall 27 which is concentric about the vertical axis 29 of the actuator cap means 10.

The inner cap 18 has a downwardly extending cylindrical wall 19 concentric about axis 29 and having a helical screw thread 20 thereon which is adapted to be screwed into a thread 11 in the bore of cylindrical wall 27 of the outer cap 12. A downwardly extending thumb tab 22 is mounted on the periphery of a rim 31 of the inner cap 18 which in cooperation with the stop 17 on the outer cap 12 positively defines the full-OFF rotational movement about axis 29 of the inner cap 18 within the outer cap 12. An upwardly projecting threaded nipple 24 is an integral part of the inner cap 18.

Figure 7:
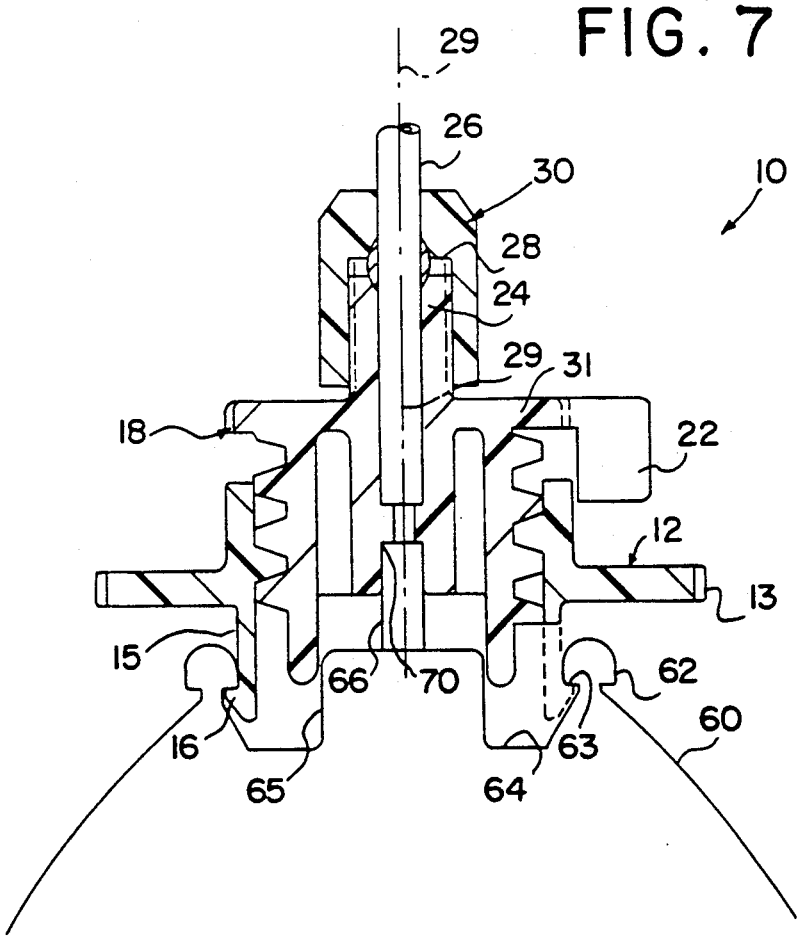
FIG. 7 illustrates an elevational sectional view of the ON/OFF control unit incorporating the outer cap of FIG. 3A and the inner cap of FIG. 2A in assembled relationship mounted on the top of a pressurized container having an upstanding delivery valve stem.

A length of flexible tubing 26 has a compression-joint sleeve 28 placed onto one end thereof. This tubing end is adapted to be secured to the actuator cap means 10, as shown in FIG. 7, by insertion of the tubing end with its compression sleeve 28 into the threaded nipple 24 to be secured therein by a compression nut 30 slid onto the tubing before the sleeve 28. This compression nut 30 is screwed down onto the threaded nipple 24 for fluid-tight attachment of the tubing to the inner cap 18.

The flexible tubing 26 is also coupled by a rear housing and wand handle 32 of an applicator wand assembly referred to generally by the reference numeral 35. A compression-joint bushing 3 is positioned onto the tubing 26 near the other end of the tubing so that the tubing is adapted to be terminated in a compression joint 36, as is shown enlarged in FIG. 9 located between the rear end of a wand valve body 40 and the housing and handle 32.

In order to make up the compression joint 36 (FIG. 9) between the flexible tubing 26 and the applicator wand 35, a compression joint sleeve 33 is slid onto the end of the tubing after the bushing 34 has been slid onto the tubing. This sleeve 33 is captured in compression between the first bushing 34 and a second bushing 37 carrying an O-ring 41. This second bushing 37 is inserted into and is mounted in the rear end of the wand valve body 40 as indicated in FIG. 1 and a shown in FIG. 9. The compression joint 36 (FIG. 9) is completed by screwing the front end of the tubular housing 32 and handle onto the screw-threaded rear end 48 (FIG. 1) of the wand valve body 40, as indicated by the dashed line 55 in FIG. 1.

FIG. 9 shows the front end of the rear housing 32 in assembled relationship screwed onto the threaded rear end 48 of the wand valve body 40. A decorative ring band 81 (FIGS. 1, 4 and 5) may be placed around the wand valve body 40 immediately in front of its threaded rear end 48.

The wand valve body 40 carries a compression spring 42 (best seen in FIG. 9), a valve plunger 44 having a cam surface 46 on one end and an 0-ring 47 encircling the valve plunger 44 in front of a radial shoulder 57 of this valve plunger. The front end of the wand valve body 40 terminates in a dispenser nozzle 50 having a bore 53. The wand valve body 40 has a valve chamber 39 (FIGS. 4 and 9) extending longitudinally therein, and the valve plunger 44 is axially movable within this valve chamber 39. The compression spring 42 is held in this valve chamber by a front end of the bushing 37. This compression spring 42 presses forwardly on the shoulder 57 of the valve plunger 44 for closing a fluid-delivery control valve 61 located within the applicator wand 35 approximately mid-way of its length for enabling convenient holding of the rear housing 32 as a handle for manipulation of the applicator wand 35 by a user.

The fluid-delivery control valve 61 includes the valve plunger 44 and the O-ring 47 which is pressed against an internal shoulder 67 by the spring 42 for closing the valve 61. When this valve 61 is closed by the spring 42, cleaning solvent is not delivered from the flexible tubing to the bore 53 of the dispenser nozzle 50.

In order to open the valve 61, a user depresses a control button 52 (FIGS. 4 and 9) of a valve actuator 69 for causing a conical camming surface 56 on the actuator 69 to act against a cam surface 46 of the valve plunger 44. This camming surface 56 axially displaces the valve plunger 44 for allowing the O-ring 47 to separate away from the internal shoulder 67, thereby opening valve 61 for allowing cleaning solvent to flow through valve chamber 39 to the nozzle bore 53.

Figure 6:
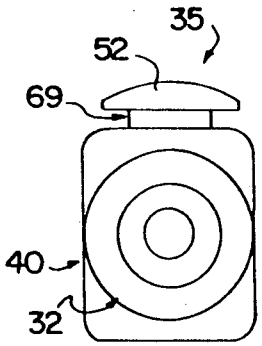
FIG. 6 is a rear elevational view of the wand shown in FIG. 5.

As shown most clearly in FIG. 6, a compression spring 58 pushes upwardly on a radial shoulder 71 of the actuator 69 for normally holding the actuator in its upper position, as is shown in FIGS. 4 and 9, for allowing the spring 42 normally to keep valve 61 in its closed position as is shown in those two FIGS. The actuator 69 is located in a socket 51 in the wand valve body 40 for allowing up and down movement of this actuator. An O-ring 54 encircles the actuator 69 in sliding sealing relationship with a side wall surface of the socket 51 for preventing escape of cleaning liquid from this socket when the valve 61 is opened for allowing delivery of solvent from valve chamber 39 through socket 51 and into nozzle bore 53.

Figure 2B:
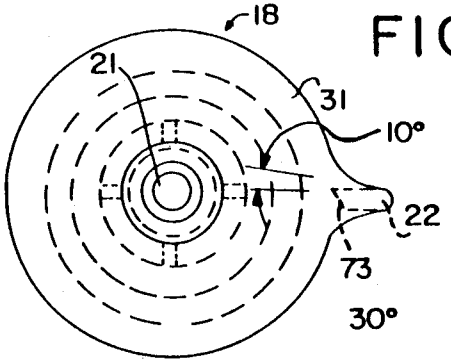
FIG. 2B is a top view of the inner cap of FIG. 2A.
Figure 2C:
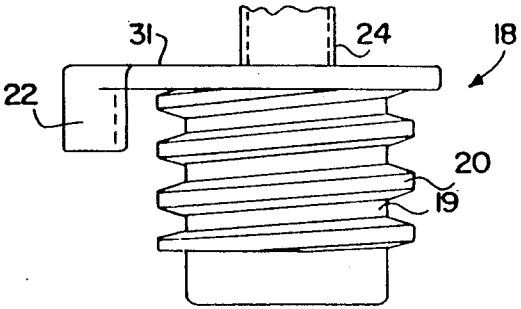
FIG. 2C is a side elevational view of the inner cap of FIGS. 2A and 2B.
Figure 2A:
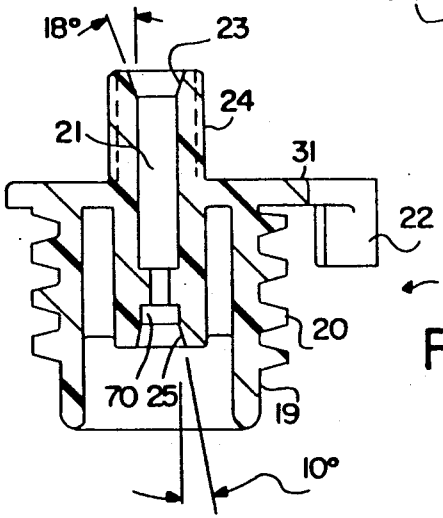
FIG. 2A is a cross-sectional view of an inner cap used in an ON/OFF control unit in the illustrative embodiment of the present invention, as shown.
Figure 5:
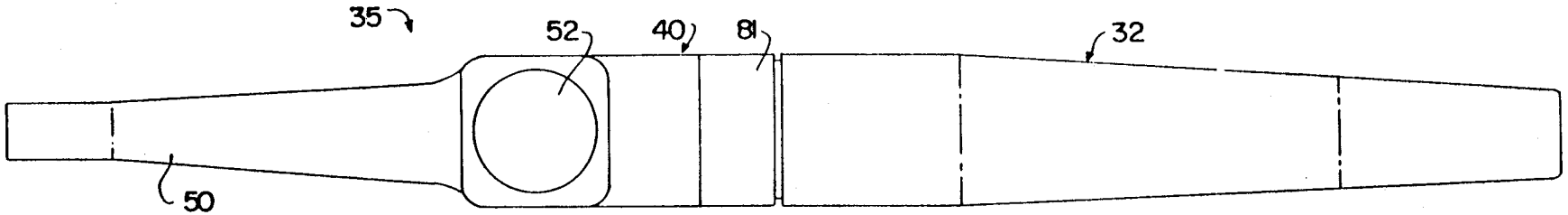
FIG. 5 is a top plan view of the wand shown in FIG. 4.

FIGS. 2A, 2B and 2C are directed to details of the inner cap 18. As will best be seen in FIG. 2A, the inner cap has a conduit passage 21 therethrough with a compression joint chamfer 23 of about 18 degrees in the upper end of its nipple 24 and a chamfer 25 of about 10 degrees in a socket 70 in the lower end thereof. This socket 70 is adapted to receive a valve stem 66 (FIG. 7) of a pressurized container 60, as will be explained later.

Figure 3B:
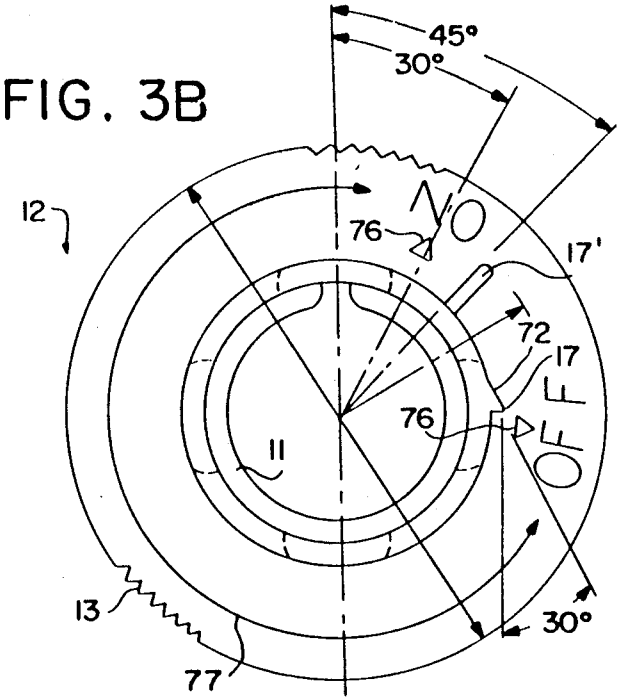
FIG. 3B is a top view of the outer cap of FIG. 3A.
Figure 3A:
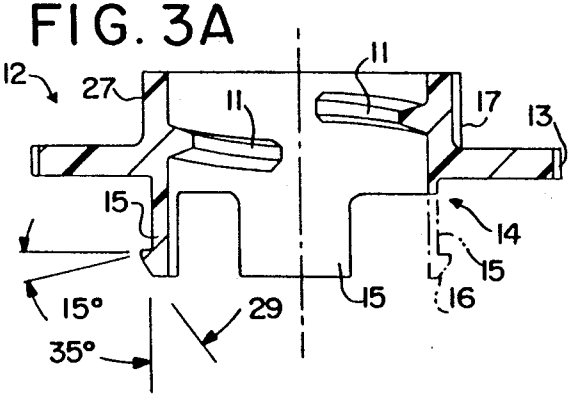
FIG. 3A is a cross-sectional view of the outer cap employed in the ON/OFF control unit in the illustrative embodiment of the present invention, as shown.

FIGS. 3A and 3B illustrate the outer cap 12 which is shown in FIG. 3A as having internal threading 11 within the cylindrical wall 27 for receiving and mating with the external threading 20 of inner cap 18. As will be seen in FIG. 3A, each of the resilient fingers 15 of the gripper clamp 14, adapted to mount the ON/OFF unit 10 on an aerosol can in a manner shown in FIG. 7, has a bottom angle ridge of about 35 degrees, as shown, with an abrupt top ledge angle, for example of about 15 degrees, projecting out from the finger 15. As will be seen in FIG. 3B, the top of the outer cap 12 includes "ON" and "OFF" designations with a second stop 17' associated with an "ON" designation and the first stop 17 associated with an "OFF" designation.

When the inner cap 18 is assembled into the outer cap 12, a tab 22 contacts the first stop 17 as the inner cap 18 is being rotated downwardly into the threading 11 of the outer cap 12. This first stop 17 has a sloping surface 72 angled at about 30 degrees to a tangent, and the tab 22 has a similar sloping inner surface 73 (FIG. 2B) which comes into contact with the sloping surface 72 as the inner cap 18 is being assembled by rotational threading into the outer cap. There is sufficient stiff resilience in the rim 31 and tab 22 for allowing the cooperating sloping surfaces 72 and 73 to cause the thumb tab 22 to become deflected sufficiently to allow this tab 22 to snap past the stop 17 for allowing completion of assembly. After assembly, when the inner cap 18 is rotated by moving the tab 22 in the reverse direction, i.e. in the counterclockwise OFF direction, it rises within the outer cap 12, until the tab 22 of the inner cap contacts the abrupt stop surface 17 at the full-OFF position. Such counterclockwise movement to the OFF position elevates the actuator cap means 10 from depressing-opening relationship of the valve stem 66 (FIG. 7) of the container on which the device is mounted, thereby allowing closure of the container valve (not shown).

Conversely, when the inner cap 18 is rotated by moving the tab 22 in its clockwise direction, i.e. in the ON direction, the inner cap 18 moves downwardly within the outer cap 12. This downward movement causes the socket 70 (FIG. 2A) of the inner cap 18 to depress the valve stem 66 (FIG. 7) of the pressurized container 60 for opening the container valve (not shown) for allowing pressurized cleaning solvent therein to be supplied up through valve stem 66 and through conduit passage 21 (FIG. 2A) into the flexible tubing 26 (FIG. 7). When the tab 22 is turned into its full-ON clockwise position, the tab 22 comes into contact with the raised rib stop 17' molded on the horizontal upper surface of the knurled rim 13 of the outer cap 12. The "OFF" and "ON" designations (FIG. 8) with their respective triangular indicia 76 and a directional arrow 77 are also molded in raised relationship on the horizontal top surface of the knurled rim 13.

Figure 8:
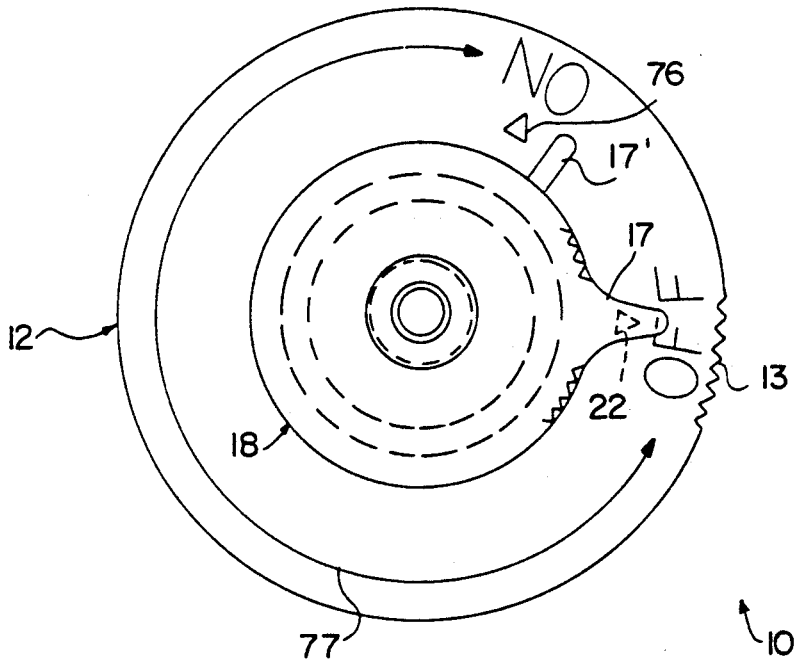
FIG. 8 is a top view of the actuator cap means illustrated in FIG. 7.

FIGS. 7 and 8 illustrate the inner cap 18 assembled within the outer cap 12 to form the ON/OFF actuator control means 10 which is mounted on a pressurized or aerosol container 60 containing the pressurized solvent or cleaning liquid which is desired to be remotely dispensed. The pressurized container 60 has an upstanding rolled rim 62 on a can closure disk top 64 having an upstanding embossed projection 65. This embossed projection 65 includes a conventional depression-type release valve having a tubular valve stem 66. The valve stem 66 is vertically mounted within the upstanding embossed projection 65 formed in the container closure disk 64. The resilient fingers 15 of the outer cap 12 are snap-on mounted onto the top of the container 60 with the abrupt-angled ledge surfaces of ridges 16 frictionally engaging beneath the inner edge 63 of rolled rim 62 of the aerosol can 60. The socket 70 (FIG. 2A) of the lower end of conduit passage 21 in the inner cap 12 receives the valve stem 66 of the container 60 guided thereinto by the chamfer 25 of the socket 70, which operatively positions the ON/OFF actuator control means 10 over the valve stem 66 in position for controlling its operation.

A knurled edge 13 of a rim of the outer cap 12 enables easy manual grip for snap-on insertion of the resilient fingers 15 of the actuator cap means 10 onto the container rim 62 beneath its inner edge 63. It is to be noted that it may be necessary to remove a normal button actuator as well as a usual protective cap of the aerosol container 60 which is being employed.

OPERATION

In operation, rotating the inner cap of the actuator cap means 10 counterclockwise as shown by the arrow 77 (FIG. 8) to the OFF position, elevates the inner cap relative to the outer cap 18, thereby lifting the socket 70 of the inner cap 18 up from depressing relationship on the valve stem actuator 66 of the pressurized container 60 for allowing closure of the container valve (not shown). When the inner cap 18 is rotated clockwise (arrow 77) to the ON position, the socket 70 of the inner cap 18 depresses the valve stem actuator 66 of the container 60 for releasing contents of the container into the flexible tubing 26 whereby it is conducted to the applicator wand 35.

As will best be seen in FIG. 4 and particularly in the enlarged partial view of the applicator wand 35 in FIG. 9, fluid from the aerosol or pressurized container 60 is fed through the flexible tubing 26 to a conduit passage 38 in the bushing 37 communicating with the valve chamber 39 of the applicator wand 35. This conduit passage 38 leads into the valve chamber 39 which houses the valve plunger 44 as well as spring 42 and the O-ring 47. This valve plunger 44 has an axially extending forward projection 43 with axially extending grooves 45 therein. These grooves 43 of the valve plunger 44 lead into the actuator socket chamber 51 which houses the actuator 69 biased upwardly by a spring 58 seated in the bottom of the socket 51. As explained above, the O-ring 54 provides a sliding seal for the actuator socket chamber 51. A nozzle bore 53 extends forwardly from the actuator chamber 51 through the dispenser nozzle 50 formed on the front end of the wand valve body 40.

As will best be seen in FIG. 9, the actuator 68 which operates in a direction transversely to the axial length of the applicator wand 35 has a conical cam surface 56 thereon forming an angle of about 30 degrees, as shown in FIG. 9, with the side wall of the actuator socket 51. This can surface 56 is adapted to contact the can surface 46 on the front end of the projection 43 of the valve plunger 44. In FIG. 9, the valve plunger 44 is illustrated in its closed position so that valve 61 prevents any fluid from travelling forward from the flexible tubing 26 to the nozzle bore 53. When the actuated button 52 is depressed by a forefinger or thumb, the can surface 56 slides against the cam surface 46 of the projection 43 of the valve plunger 44 for forcing the valve plunger axially to the right as shown in FIG. 9 for permitting the O-ring 47 to move away from the stationary valve shoulder 67 for allowing fluid to flow from the tubing 26 through the conduit passage 38 and through the valve chamber 39 past clearance around rim 57 of the valve plunger 44 and then to flow past the now open seal 47 and then through the grooves 45 into the actuator chamber 51 and from there through the bore 53 out through the nozzle 50. When the button 52 is released, the valve 61 is again closed by spring 42, thereby providing a very convenient mode of actuation for delivery of cleaning solvent through the applicator wand 35 to a brush 68 (FIG. 4A).

The nozzle 50 advantageously projects forwardly at least about 1.5 inches beyond the centerline 80 (FIG. 9) of the button actuator 52, 69 for conveniently enabling reaching of the dispensing end of this nozzle into narrow places of difficult access. Moreover, by virtue of the fact that this button actuator 52, 69 is located at least about 1.5 inches and preferably at about 1.8 inches from the front end of the nozzle 50, the user has an unobstructed access by and an unobstructed view of the front end of the nozzle. Such unobstructed access and unobstructed view is not provided by the apparatus shown in U.S. Pat. No. 3,650,438 where the user's finger must be at the front for tilting a front-end nozzle tip with side-opening delivery.

The user may direct the nozzle end 50 to the area which is desired to be cleaned, and a cleaning implement such as the cleaning brush 68, shown in FIG. 4A, has its shank 78 inserted into the bore 53 of the nozzle 50 for delivering the fluid from the pressurized container 60 directly onto the brush 68 which may thereby be used to brush the cleaning solvent or other cleaning liquid directly on the work surface. Other implements may be used or the solvent may be applied directly from the nozzle 50 without the use of an applicator such as the brush 68.

Among the many advantages of the present system are the provision of an ON/OFF control valve unit 10 directly on top of the container 60 to which the system is attached. The actuator cap means comprising this ON/OFF control unit 10 is securely snap-on gripped to the top of the pressurized container, so that it will not readily become dislodged. In addition, the applicator wand 35 has a valve control 52 button which is conveniently located in an intermediate or mid-position on the wand. This intermediate or mid-position of the actuator button 52 permits the user to have a firm grip on the applicator wand for ease of manipulation, as is not the same when the nozzle has a tiltable side-opening delivery actuator button on the front end thereof, as shown in U.S. Pat. No. 3,650,438.

The present applicator wand enables easy insertion of implements into the nozzle bore 53, which cannot be done with a release valve button mounted on the front end of the nozzle, as shown in that Patent. Moreover, this tilting valve button in the Patent has a discharge port awkwardly located on one side of the valve tip. The present entire system has relatively few pieces and does not require sonic welding for assembling the parts together. The convenient construction, assembly and operation as well the easy manner in which the ON/-

OFF control unit 10 is snapped onto a pressurized container saves time, effort and expense. By having an ON/OFF control unit directly on top of the container, a considerable amount of pressurized fluid is conserved during each cleaning operation in cooperation with the convenient effective push-button actuated valve in the applicator wand, which is easy to control and manipulate in one hand by the user.

Just before the operator is finished using the applicator wand 35, the ON/OFF control unit 10 is turned off. Consequently, the last few cleaning strokes of the applicator wand are supplied with pressurized fluid already in the flexible tubing 26. In other words, no further fluid issues from the pressurized container 60 since its control 10 is already shut OFF. Thus, the tubing 26 is efficiently emptied of its contents for actual effective use of the fluid already in the tubing. The overall length of the applicator wand 35 (as shown about twice full size in FIG. 4) is at least bout 4.5 inches and is preferred to be at least about 5.4 inches for providing an easy-to-grasp handle 32 for convenient and accurate manipulation of the nozzle 50 and for providing a good hand-hold for operating the actuator 52. 69. The button actuator 52, 69 has a preferred vertical range of travel of no more than about 0.10 of an inch from full closure to full opening of the valve 61. In this illustrative embodiment the button actuator 52. 69 has a travel range of about 0.07 of an inch.

Since other changes and modifications varied to fit particular operating requirements and environments will be understood by those skilled in the art, the invention is not considered limited to the examples chosen for purposes of illustration and includes all changes and modifications which do not constitute a departure from the true spirit and scope of this invention as claimed in the following claims and equivalents thereof.

We claim:

1. A hand-operated cleaning wand system including ON/OFF control means adapted to be detachably mounted on a pressurized fluid container having an upstanding closure valve stem for dispensing pressurized fluid from the container when this valve stem is actuated by depressing movement thereof, said system comprising:

said ON/OFF control means having an outer cap with gripping means on a lower end thereof adapted to engage and to mount said control means on a pressurized container which can dispense a pressurized fluid through the valve stem of such a container upon depressing movement of the valve stem thereof;

an inner cap mounted for helical ON/OFF movement in said outer cap;

an ON movement of said inner cap turning said inner cap helically downwardly relative to said outer cap for providing downward depressing movement of said inner cap suitable for depressing actuation of a valve stem of such a container;

an OFF movement of said inner cap turning said inner cap helically upward relative to said outer cap for providing upward movement of said inner cap suitable for stopping dispensing of pressurized fluid upon upward movement of such a valve stem;

said ON/OFF control means having a first fluid passageway therein for conducting pressurized fluid from such a valve stem when such a valve stem is actuated;

said inner cap having a thumb tab for hand-operated turning of said inner cap relative to said outer cap in said ON and OFF movement;

said outer cap having ON and OFF stops thereon respectively engaged by said inner cap for limiting ON and OFF turning movement of said inner cap relative to said outer cap;

a length of flexible tubing having first and second ends;

said first end of said tubing being coupled to said ON/OFF control means in communication with said first fluid passageway;

a hand-operated wand having a second fluid passageway extending therein;

said second end of said tubing being coupled to said wand in communication with said second fluid passageway;

said wand having a nozzle with a bore communicating with said second fluid passageway;

valve means positioned in said second fluid passageway in said wand for opening and closing a path through said second fluid passageway from said tubing to said nozzle bore; and a button actuator mounted in said wand for operating said valve means to open and close said valve means for dispensing fluid from said nozzle bore.

2. A hand-operated cleaning wand system as claimed in claim 1, wherein:

said outer cap has a projecting region for manually holding said outer cap during hand-operation of said thumb tab for turning said inner cap relative to said outer cap in said ON and OFF turning movement;

said outer cap has "ON" and "OFF" indicia near said ON and OFF stops, respectively; and said thumb tab engages said ON and OFF stops respectively for stopping said ON and OFF turning movement, when said thumb tab is aligned with the respective "ON" and "OFF" indicia.

3. A hand-operated fluid-dispensing wand system as claimed in claim 1, in which:

said button actuator is movably mounted in a socket in said wand;

said button actuator is movable in a direction transversely of said wand;

spring means in said wand urge said button actuator upwardly in said socket;

said valve means includes a valve plunger movable between closed and open positions;

said valve plunger has a projection thereon extending into said socket;

said button actuator has a cam surface positioned above said projection;

said cam surface slidably engages said projection on said valve plunger for moving said valve plunger from its closed to its open position, upon manually depressing said actuator in said socket;

said socket communicates with said nozzle bore and is included in said second fluid passageway; and said projection has a plurality of grooves therein extending longitudinally of said projection for conducting fluid along said grooves into said socket upon depressing said button actuator for moving said valve plunger from closed to open position for conducting fluid along said grooves into said socket and thence out through said nozzle bore.

4. A hand-operated fluid-dispensing wand system as claimed in claim 3, in which:

said button actuator has an O-ring encircling said actuator;

said O-ring is positioned above said cam surface; and said O-ring is in slidable sealing engagement with said socket.

5. A hand-operated fluid-dispensing wand system including ON/OFF control means adapted to be detachably mounted on a pressurized fluid container having an upstanding closure valve stem for dispensing pressurized fluid from the container when this valve stem is actuated, said system comprising:

said ON/OFF control means having an outer cap with gripping means on a lower end thereof adapted to engage and mount said control means on such a pressurized container which can dispense a fluid upon actuation of such a valve stem;

an inner cap mounted for ON/OFF movement in said outer cap;

an ON movement of said inner cap being in a direction suitable for actuating such a valve stem on such a container for releasing pressurized fluid from the container;

an OFF movement of said inner cap being in a direction suitable for deactuating such a valve stem for stopping release of fluid from such a container;

said ON/OFF control means having a first fluid passageway therein for conducting fluid from such a container when such a valve stem is actuated;

a length of flexible tubing having first and second ends;

said first end of said tubing being coupled to said ON/OFF control means in communication with said first fluid passageway;

a hand-operated wand having a second fluid passageway extending therein;

said second end of said tubing being coupled to said wand in communication with said second fluid passageway;

said wand having a nozzle with a bore communicating with said second fluid passageway;

valve means positioned in said second fluid passageway in said wand for opening and closing a path through said second fluid passageway from said tubing to said nozzle bore;

a button actuator mounted in said wand for operating said valve means to open and close said valve means for dispensing fluid from said nozzle bore;

said inner cap being mounted for helical turning movement within said outer cap;

said inner cap having a thumb tab extending downwardly from a rim of said inner cap for enabling a user to turn said inner cap with a helical turning movement about an axis relative to said outer cap;

said outer cap having a first stop projecting radially thereon;

said first stop having an abrupt stop surface on one side and a sloping surface on another side;

said thumb tab and said rim of said inner cap being stiff yet sufficiently resilient for allowing said tab to deflect for sliding over said sloping surface of said first stop during assembly of said inner cap into said outer cap by helically turning said inner cap into said outer cap;

said helical turning of said inner cap into said outer cap being the ON turning direction;

said abrupt stop surface of said first stop being contractible by said thumb tab subsequent to such assembly for defining an OFF position of said inner cap relative to said outer cap;

said outer cap having a second stop spaced from said first stop and being contacted by said thumb tab for defining an ON position of said inner cap; and said outer cap having an "OFF" indication near said first stop and an "ON" indication near said second stop.

6. In a hand-operated cleaning system, an ON/OFF control unit adapted for mounting onto a top rim of a container of pressurized fluid having a depressible valve stem encircled by said rim and wherein fluid is dispensed from the container through said valve stem by depressing said valve stem, said ON/OFF control unit comprising:

an outer cap having snap-on gripping means adapted to engage the top rim of such a container for mounting said control unit on the container;

an inner cap assembled with the outer cap for helical turning movement of said inner cap within said outer cap;

said inner cap having a thumb tab extending downwardly from a rim of said inner cap for enabling a user to turn said inner cap with a helical turning movement about an axis relative to said outer cap;

said outer cap having a cylindrical outer surface concentric with said axis;

a first stop projecting outwardly from said outer surface;

said first stop having an abrupt stop surface on one side and a sloping surface on another side;

said thumb tab and said rim of said inner cap being stiff and yet being sufficiently resilient for allowing said tab to deflect for sliding over said sloping surface of said first stop during assembly of said inner cap into said outer cap by helically turning said inner cap into said outer cap;

said helical turning of said inner cap into said outer cap being an ON turning direction of said inner cap relative to said outer cap for moving said inner cap in a downward depressing direction relative to said outer cap;

said abrupt stop surface of said first stop being contractible by said thumb tab subsequent to such assembly for defining an OFF position of said inner cap relative to said outer cap;

said outer cap having a second stop spaced from said first stop and being contacted by said thumb tab for defining an ON position of said inner cap;

said inner cap having a socket adapted for engagement upon a depressible valve stem of such a container;

said inner cap having coupling means thereon for attachment to a length of flexible tubing; and said inner cap having a passageway from said socket to said coupling means for providing communication between said socket and said flexible tubing for enabling fluid to be delivered from said socket to said flexible tubing.

* * * * *